US006637447B2

(12) United States Patent
McMullin et al.

(10) Patent No.: US 6,637,447 B2
(45) Date of Patent: Oct. 28, 2003

(54) BEERBRELLA

(76) Inventors: Mason Schott McMullin, #7 Ridgetop St., St. Louis, MO (US) 63117; Robert Platt Bell, 8033 Washington Rd., Alexandria, VA (US) 22308; Mark Andrew See, 8033 Washington Rd., Alexandria, VA (US) 22308

( * ) Notice: Subject to any disclaimer, the term of this patent is extended or adjusted under 35 U.S.C. 154(b) by 33 days.

(21) Appl. No.: 09/981,966

(22) Filed: Oct. 19, 2001

(65) Prior Publication Data

US 2003/0075208 A1 Apr. 24, 2003

(51) Int. Cl.[7] ..... A45B 11/00; A45B 13/00; A45B 23/00

(52) U.S. Cl. ..... 135/16; 220/694; 206/217

(58) Field of Search ..... 135/16; 220/694, 220/703; 215/386, 400; D3/5; 248/519, 534, 231.81, 230.7; 206/217

(56) References Cited

U.S. PATENT DOCUMENTS 973,731 A * 10/1910 Watkins
2,199,915 A * 5/1940 Howard
2,556,439 A * 6/1951 Pearson ..... 215/386
4,188,965 A * 2/1980 Morman ..... 135/16
4,638,645 A 1/1987 Simila ..... 62/457
4,871,141 A * 10/1989 Chen ..... 248/534
5,058,757 A * 10/1991 Proa ..... 220/739
5,086,712 A * 2/1992 Clark ..... 108/50.12
5,115,939 A * 5/1992 Porter ..... 220/705
5,186,196 A * 2/1993 Gorka et al. ..... 135/16
5,365,966 A * 11/1994 McLaren ..... 135/16
5,396,915 A * 3/1995 Bomar ..... 135/16
D361,018 S * 8/1995 Drape et al. ..... D7/619
5,544,783 A * 8/1996 Conigliaro ..... 220/735
D394,589 S * 5/1998 King ..... D7/707
5,823,496 A 10/1998 Foley et al. ..... 248/314

* cited by examiner

*Primary Examiner*—Robert Canfield
(74) *Attorney, Agent, or Firm*—Robert Platt Bell

(57) ABSTRACT

The present invention provides a small umbrella ("Beerbrella") which may be removably attached to a beverage container in order to shade the beverage container from the direct rays of the sun. The apparatus comprises a small umbrella approximately five to seven inches in diameter, although other appropriate sizes may be used within the spirit and scope of the present invention. Suitable advertising and/or logos may be applied to the umbrella surface for promotional purposes. The umbrella may be attached to the beverage container by any one of a number of means, including clip, strap, cup, foam insulator, or as a coaster or the like. The umbrella shaft may be provided with a pivot to allow the umbrella to be suitably angled to shield the sun or for aesthetic purposes. In one embodiment, a pivot joint and counterweight may be provided to allow the umbrella to pivot out of the way when the user drinks from the container.

10 Claims, 5 Drawing Sheets

Figure 6
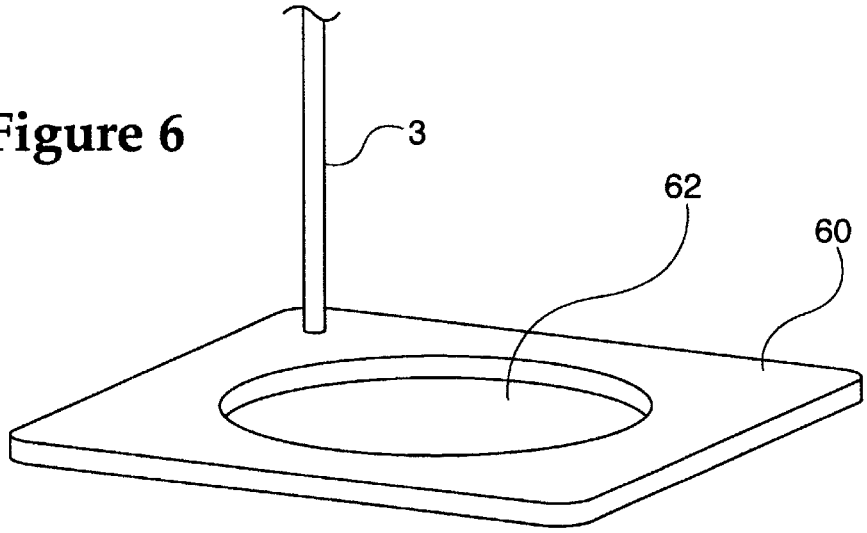
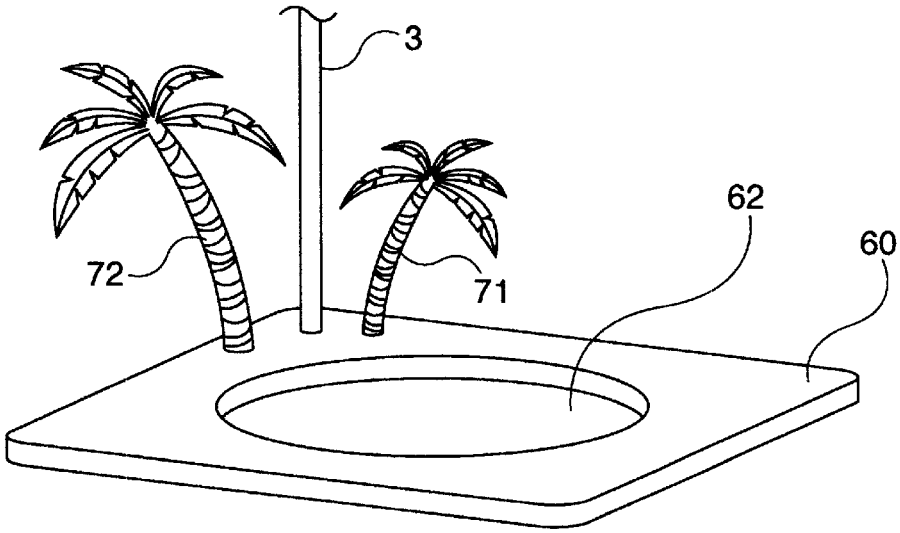
Figure 7

BEERBRELLA

FIELD OF THE INVENTION

The present invention relates to a novelty accessory for use with beverages. In particular, the present invention is directed toward a small attachable umbrella ("Beerbrella") which may be attached to a beverage container (e.g., glass or can of beer).

BACKGROUND OF THE INVENTION

Beverage accessories are known in the art for use with beverage containers, be they glasses, cans, or bottles, and in particular with alcoholic beverages. Many of these accessories provide novelty amusement as well as practical effects, such as increased insulation to keep a beverage cold. Many of these accessories are sold or given away as promotional items for advertising purposes.

For example, the popular insulated beverage sleeve known as a "coozie" may be provided, manufactured of soft expanded polyurethane foam. These beverage sleeves are typically provided with an applied graphic advertising a beverage brand or the name of the company giving away the device as a promotion. A can, glass, or bottle may be inserted into the sleeve. The sleeve acts as an insulator to prevent ambient heat as well as heat from the user's hands, from warming the beverage.

Similar devices are known for use specifically with bottles beverages. In this variation, a tailored expanded polyurethane jacket may be provided, replete with zipper, to encapsulate substantially all of a bottle.

Various devices are known for supporting beverages, such as coasters and the like as well as beverage stands, trays, and supports. One example is illustrated in Foley et al., U.S. Pat. No. 5,823,496, issued Oct. 20, 1998 and incorporated herein by reference. Foley provides an outdoor stand with a stake or pole which may be inserted into the ground to support a beverage container.

Similia, U.S. Pat. No. 4,638,645, issued Jan. 27, 1987 and incorporated herein by reference, discloses a beverage container cooler for receiving a single beverage container (e.g., can) and providing a location for ice or the like to cool the beverage.

One problem with these Prior Art devices is that although they do provide insulation for beverages, they do not shield the beverage from the direct rays of the sun. A beverage left out in the sun, even if insulated or cooled with ice, quickly warms due to the effect of the intense infrared radiation from the sun, particularly on hot, sunny summer days.

Thus, it remains a requirement in the art to provide a means for shielding a beverage from direct sunlight.

SUMMARY OF THE INVENTION

The present invention provides a small umbrella ("Beerbrella") which may be removably attached to a beverage container in order to shade the beverage container from the direct rays of the sun. The apparatus of the present invention has particular application for use in sunny locations (e.g., poolside, at the bear, outdoor bars, and the like). However, the apparatus of the present invention may also be used to prevent rain or other precipitation from contaminating a beverage.

In addition, the apparatus of the present invention may be used in other locations (e.g., indoors) purely as a decorative novelty item or the like.

The apparatus comprises a small umbrella approximately five to seven inches in diameter, although other appropriate sizes may be used within the spirit and scope of the present invention. The umbrella may be made from any one of a number of materials. A small paper-like umbrella may be used, with balsa framing (e.g., in a similar manner to a cocktail umbrella) if low cost and disposability is an objective. A solid plastic umbrella may also be inexpensively made and may be reusable and waterproof. More elaborate umbrella types such as cloth or the like may also be employed without departing from the spirit and scope of the present invention.

Suitable advertising and/or logos may be applied to the umbrella surface for promotional purposes. The umbrella may be attached to the beverage container by any one of a number of means, including clip, strap, cup, foam insulator, or as a coaster or the like. The umbrella shaft may be provided with a pivot to allow the umbrella to be suitably angled to shield the sun or for aesthetic purposes. In one embodiment, a pivot joint and counterweight may be provided to allow the umbrella to pivot out of the way when the user drinks from the container.

BRIEF DESCRIPTION OF THE DRAWINGS

FIG. 6 is a front perspective view of a coaster for supporting the umbrella of the present invention.

FIG. 7 is a front perspective view of an alternative embodiment of a coaster for supporting the umbrella of the present invention.

DETAILED DESCRIPTION OF THE INVENTION

Figure 1:
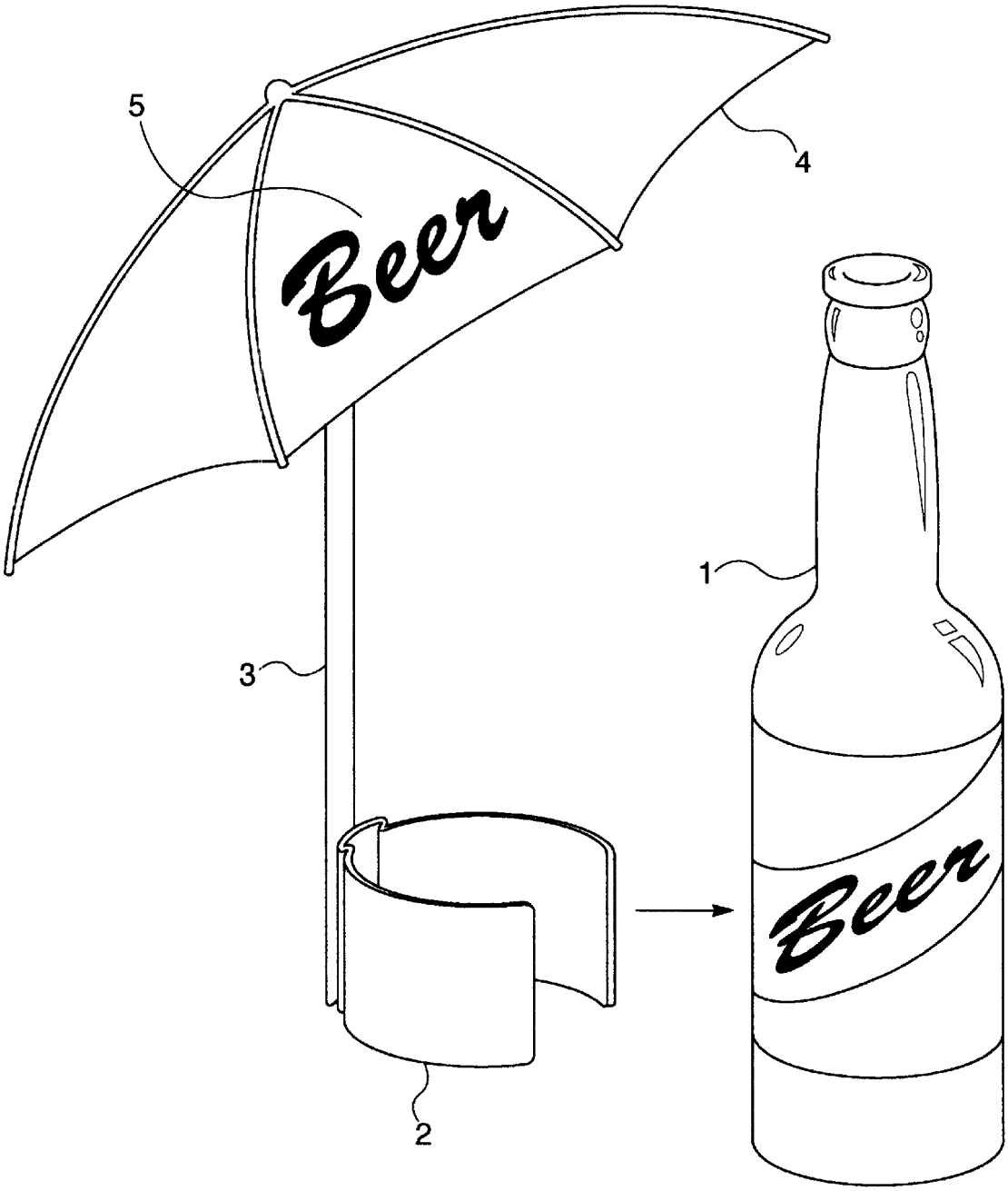
FIG. 1 is a front perspective view of a first embodiment of the present invention.

FIG. 1 is a front perspective view of a first embodiment of the present invention. In the embodiment of FIG. 1, clip 2 may be provided to attach to container 1 by means of spring action and friction. Clip 2 may be made of spring steel, or preferably plastic (e.g., PVC or the like). Clip 2 may even be made of formed cardboard (e.g., cut cardboard tube or the like) if low cost is an issue.

Clip 2 may be removably attached to container 1 such that the apparatus may be reused on another container when container 1 is empty. Attached to clip 2 is shaft 3 for supporting umbrella 4. Umbrella 4 may be fixed to shaft 3 or may be attached using a pivot joint or the like as will be discussed in more detail below. Shaft 3 may be made of plastic, wood, cardboard, or metal, but in the preferred embodiment is plastic.

As will be discussed in more detail below, umbrella 4 may be attached to the beverage container 1 by any one of a number of means, including clip, strap, cup, foam insulator, or as a coaster or the like. The clip of FIG. 1 is by way of example only and is not intended to limit the scope of the present invention in any way.

Umbrella 4 may comprise a small umbrella approximately five to seven inches in diameter, although other appropriate sizes may be used within the spirit and scope of the present invention. Umbrella 4 may be made from any one of a number of materials. A small paper-like umbrella 4 may be used, with balsa framing (e.g., in a similar manner to a cocktail umbrella) if low cost and disposability is an objective.

In the preferred embodiment, umbrella 4 may comprise a solid plastic umbrella which may be inexpensively made and may be reusable and waterproof. More elaborate umbrella types such as cloth or the like may also be employed without departing from the spirit and scope of the present invention. Suitable advertising and/or logos 5 may be applied to the surface of umbrella 4 for promotional purposes.

Figure 2:
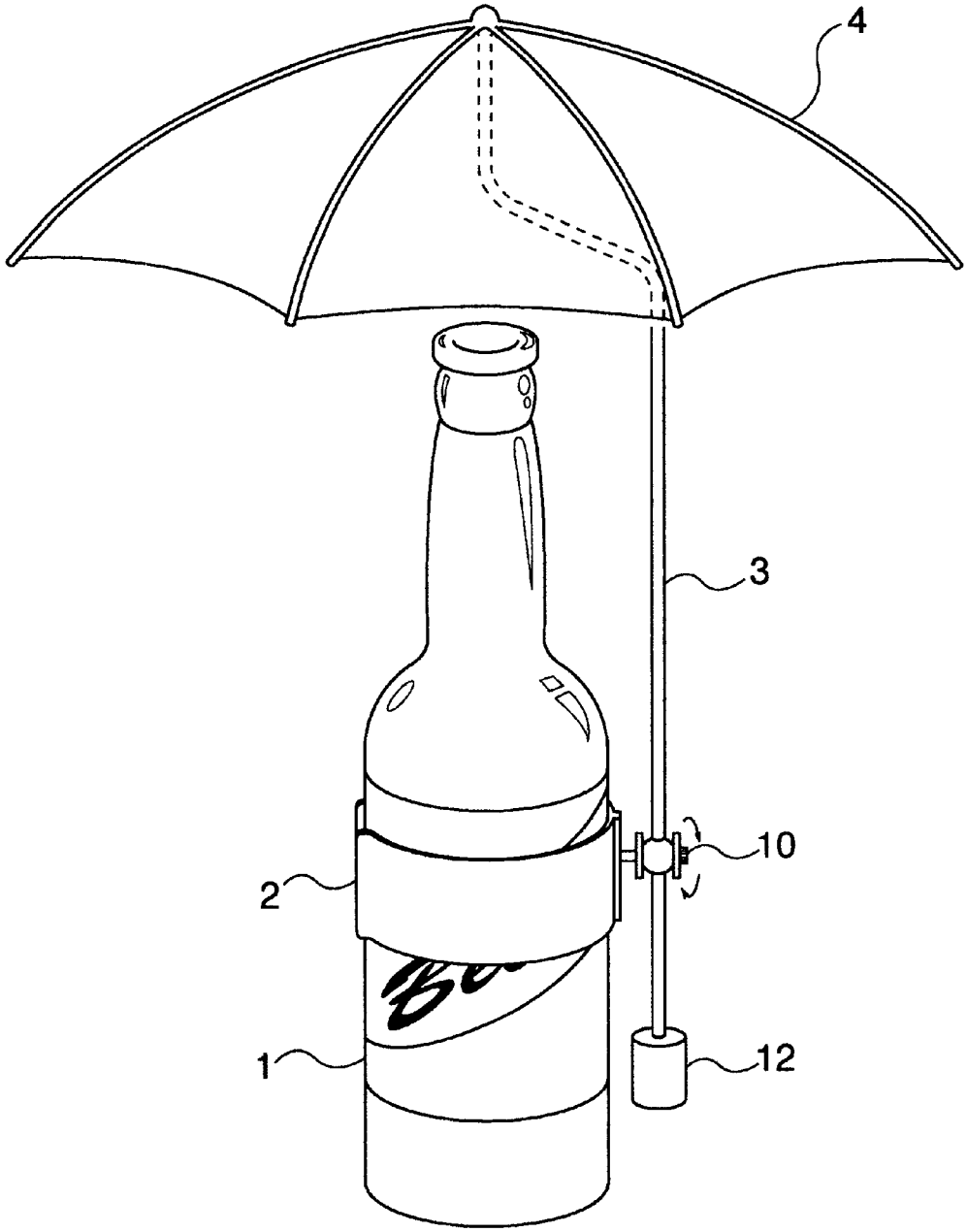
FIG. 2 is a front perspective view of a second embodiment of the present invention.
Figure 3:
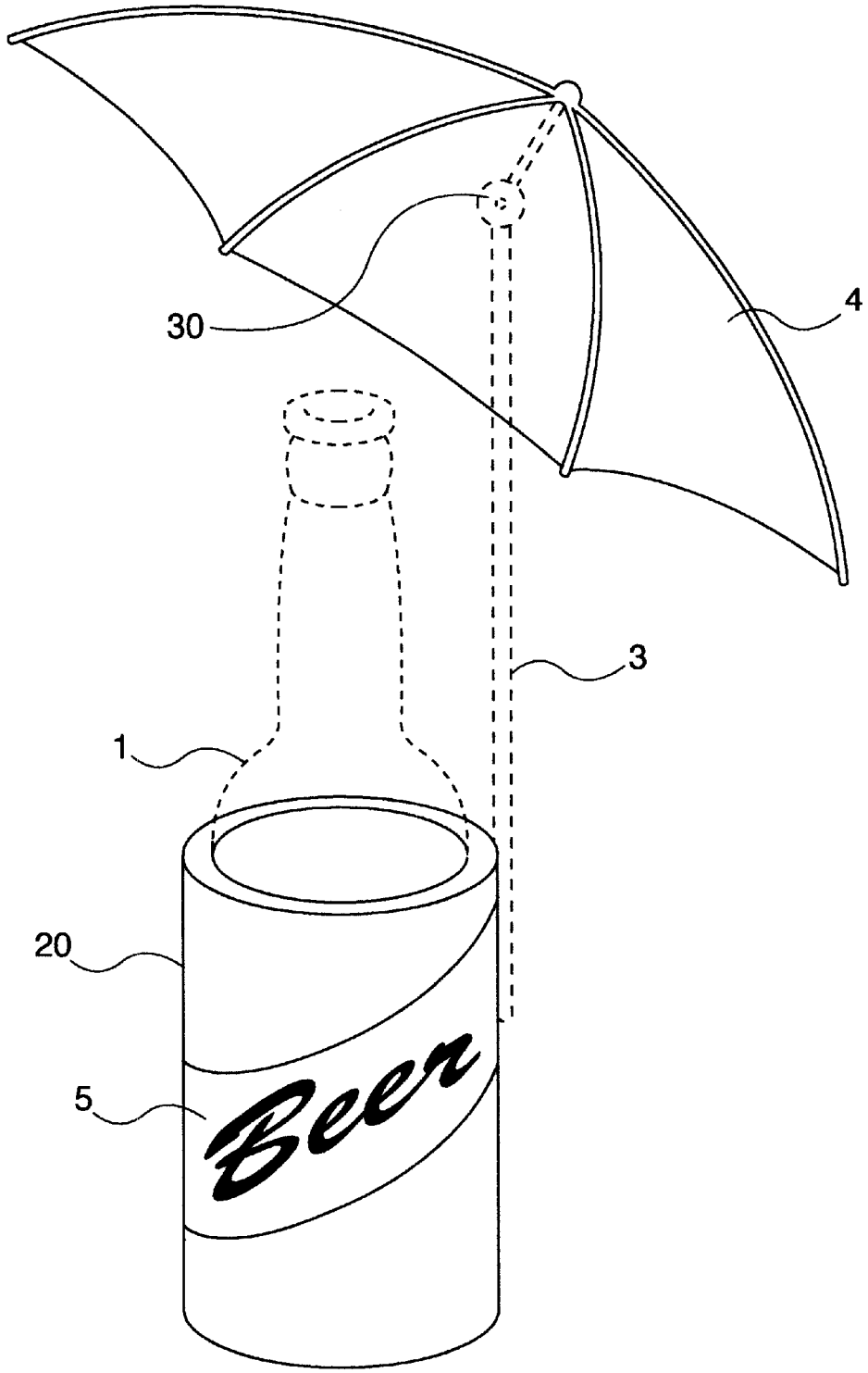
FIG. 3 is a front perspective view of a third embodiment of the present invention.

FIG. 2 is a front perspective view of a second embodiment of the present invention. In the embodiment of FIG. 3, umbrella shaft 3 may be provided with a pivot joint 10 and counterweight 12 to umbrella 4 to pivot out of the way when the user drinks from the container. When the user places the container back in an upright position, umbrella 4 will automatically pivot back into position by action of gravity.

FIG. 3 is a front perspective view of a third embodiment of the present invention. In the embodiment of FIG. 2, umbrella shaft 3 may be provided with a pivot 30 to allow the umbrella to be suitably angled to shield the sun or for aesthetic purposes. This pivot 30 may be applied also to the embodiments of FIGS. 1 and 2 without departing from the spirit and scope of the present invention.

Also as illustrated in the embodiment of FIG. 3, shaft 3 may be mounted to an expanded polyurethane "coozie" insulated drink holder. The combination of shading and insulation may maintain the beverage in container 1 at a cold temperature for a longer period of time. Note that the use of the coozie mount does not require the use of the pivot 30. Both elements are shown here for the sake of illustration.

Figure 4:
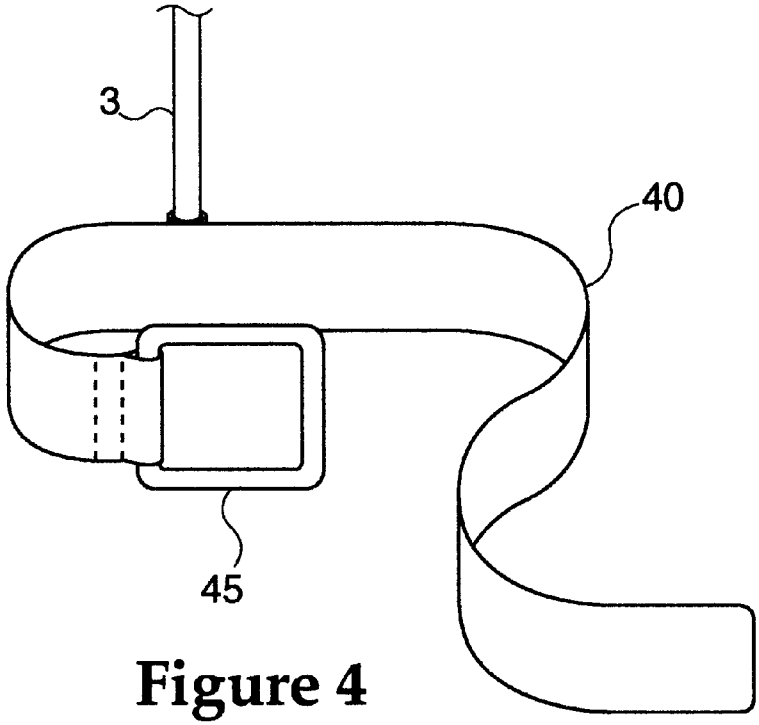
FIG. 4 is a front perspective view illustrating an alternative attachment device for the present invention.

FIG. 4 is a front perspective view illustrating an alternative attachment device for the present invention. In the embodiment of FIG. 4, a strap 40 may be provided to secure shaft 3 to the container 1 (not shown) by encompassing container 1. Strap 40 may be provided with a buckle, velcro, or other type or strap securing mechanism as are known in the art.

Figure 5:
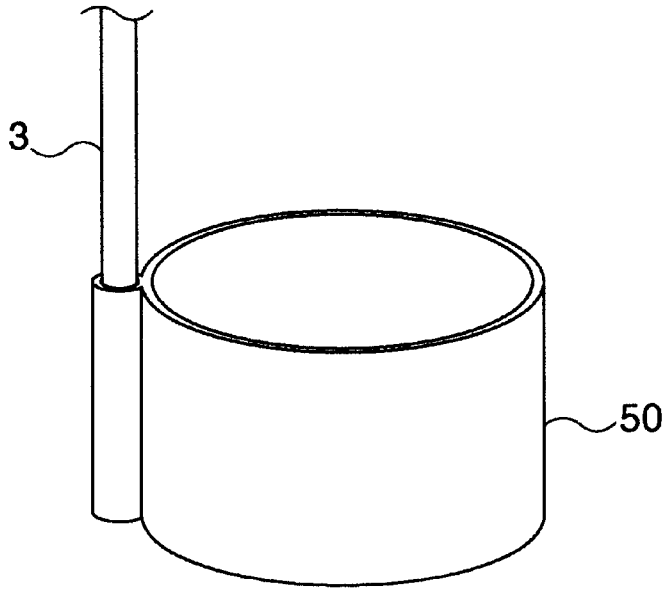
FIG. 5 is a front perspective view illustrating another alternative attachment device for the present invention.

FIG. 5 is a front perspective view illustrating another alternative attachment device for the present invention. In the embodiment of FIG. 5, a cup 50 is provided to fit securely to the bottom of a drink container such as a can or bottle.

FIG. 6 is a front perspective view of a coaster for supporting the umbrella of the present invention. In the embodiment of FIG. 6, shaft 3 is attached to a coaster 60 which may have a depressed portion 62 for accepting a beverage container. When the user wishes to drink, they remove the beverage container from the drink coaster. In such an embodiment, the umbrella (not shown) remains with the coaster, which may be weighted to prevent the apparatus from becoming top-heavy.

FIG. 7 is a front perspective view of an alternative embodiment of a coaster for supporting the umbrella of the present invention. In the embodiment of FIG. 7, coaster 60 has been embellished with decorative palm trees 71 and 72 to give coaster 60 the appearance of a stereotypical "desert island". Since some beverage manufacturers use themes of tropical paradises in promoting their beverages, the use of such a theme may be useful in promoting such beverages.

While the preferred embodiment and various alternative embodiments of the invention have been disclosed and described in detail herein, it may be apparent to those skilled in the art that various changes in form and detail may be made therein without departing from the spirit and scope thereof.

We claim:

1. A combined beverage container and shading apparatus, comprising:

a beverage container, for containing a beverage;

a means for removably attaching the apparatus to the beverage container;

a shaft, coupled to the means for removably attaching the apparatus, and extending vertically with respect to the beverage container;

an umbrella, coupled to the shaft at a point above the means for removably attaching, so as to shade the beverage container, wherein the means for removably attaching comprises a clip provided to attach to the beverage container by means of spring action and friction.

2. The apparatus of claim 1, wherein the umbrella comprises a small umbrella approximately five to seven inches in diameter.

3. The apparatus of claim 1, wherein the umbrella comprises a small paper-like umbrella with balsa framing.

4. The apparatus of claim 1, wherein the umbrella comprises a solid plastic umbrella.

5. The apparatus of claim 1, wherein the umbrella comprises a cloth umbrella.

6. The apparatus of claim 1, further comprising:

a pivot joint, coupled between the shaft and the means for removably attaching; and a counterweight, coupled to the shaft, wherein the shaft extends downward from the pivot joint and the counterweight is coupled to the shaft at a location below the pivot joint such that when the beverage container is tilted, the shaft remains substantially vertical.

7. The apparatus of claim 1, further comprising:

a pivot coupling the shaft to the umbrella to allow the umbrella to be suitably angled to shield the sun or for aesthetic purposes.

8. The apparatus of claim 1, wherein the clip is made of spring steel.

9. The apparatus of claim 1, wherein the clip is made of passtic.

10. The apparatus of claim 1, wherein the clip is made of formed cardboard.

* * * * *